US010559916B1

(12) United States Patent
Lo

(10) Patent No.: US 10,559,916 B1
(45) Date of Patent: Feb. 11, 2020

(54) ADAPTER ASSEMBLY

(71) Applicant: DELTA ELECTRONICS, INC., Taoyuan (TW)

(72) Inventor: Tzu-Hao Lo, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/366,788

(22) Filed: Mar. 27, 2019

Related U.S. Application Data

(60) Provisional application No. 62/715,676, filed on Aug. 7, 2018.

(30) Foreign Application Priority Data

Dec. 28, 2018 (CN) ..... 2018 1 1627432

(51) Int. Cl.
*H01R 13/453* (2006.01)
*H01R 13/623* (2006.01)
*H01R 13/625* (2006.01)
*H01R 13/52* (2006.01)

(52) U.S. Cl.
CPC ..... *H01R 13/5219* (2013.01); *H01R 13/4532* (2013.01); *H01R 13/623* (2013.01); *H01R 13/625* (2013.01)

(58) Field of Classification Search
CPC H01R 13/623; H01R 13/625; H01R 13/5219; H01R 13/4532; H01R 31/06
See application file for complete search history.

(56) References Cited

U.S. PATENT DOCUMENTS 4,395,082 A * 7/1983 Rumble ..... H01R 13/4532 439/139
5,697,798 A * 12/1997 Marechal ..... H01R 13/4532 439/139
8,210,858 B2 * 7/2012 Lee ..... H01R 24/68 439/108
9,146,023 B2 * 9/2015 Keser ..... F21V 19/0005
(Continued)

*Primary Examiner* — Briggitte R. Hammond
(74) *Attorney, Agent, or Firm* — Kirton McConkie; Evan R. Witt

(57) ABSTRACT

The present invention provides a power adapter assembly including a first adapter and a second adapter. The first adapter includes a main body and a rotating cover. The main body includes a first electrical contact element. The rotating cover is pivotally connected with the main body and rotated between a first position and a second position. The rotating cover includes a first through hole and a protruding pin. The protruding pin is disposed adjacent to the outer edge of the rotating cover. At the first position, the first through hole and the first electrical contact element are misaligned with each other. At the second position, the first through hole and the first electrical contact element are aligned with each other. The second adapter includes a second electrical contact element, an accommodation space and a guiding groove. The guiding groove is disposed on the inner wall of the accommodation space. When the first adapter and the second adapter are matched with each other, the guiding groove abuts against the protruding pin to drive the rotating cover to the second position, so as to electrically connect the first electrical contact element and the second electrical contact element.

20 Claims, 18 Drawing Sheets

(56) References Cited

U.S. PATENT DOCUMENTS

| | | | | |
|---|---|---|---|---|
| 9,667,008 | B2 * | 5/2017 | Hsieh | H01R 27/02 |
| 10,164,368 | B1 * | 12/2018 | Hsiao | H01R 31/06 |
| 10,211,583 | B2 * | 2/2019 | Liao | H01R 13/701 |
| 2010/0273342 | A1 * | 10/2010 | Hankins | H01R 13/625 439/332 |
| 2017/0125939 | A1 * | 5/2017 | Relue | H01R 13/5219 |

* cited by examiner

1

1

1

1

1a

1a

1a

ADAPTER ASSEMBLY

CROSS-REFERENCE TO RELATED APPLICATION

This application claims the benefit of U.S. Provisional Application No. 62/715,676 filed on Aug. 7, 2018, and entitled "ADAPTER ASSEMBLY". This application claims priority to China Patent Application No. 201811627432.X, filed on Dec. 28, 2018. The entire contents of the above-mentioned applications are incorporated herein by reference for all purposes.

FIELD OF THE INVENTION

The present disclosure relates to an adapter, and more particularly to an adapter assembly with safety design to avoid electrical shock issue and provide waterproof and dustproof functions.

BACKGROUND OF THE INVENTION

Electrical connector assembly or adapter assembly has been widely applied in various fields for conveying electric power from a power supplying end to a power receiving end. For example, an adapter assembly has been used for transferring electric power from a charging station or a utility power source to a battery mounted in an electric vehicle or a hybrid electric vehicle, and an electrical connector assembly including an industrial plug and a socket has been used for transferring power from a power source to an electrical equipment.

Trust in the safety and reliability of the electrical connector assembly or adapter assembly is very important for user. Namely, it is very import that the electrical connector assembly or the adapter assembly should not suffer from leakage of electricity. The electrical connector assembly or adapter assembly are often used outdoors, there is a great risk that some environmental substances such as water or dust may enter into the electrical connector assembly or adapter assembly. If the water or dust is introduced into the electrical connector or adapter, the user may suffer from an electrical shock at the moment that the electrical connector or adapter is connected with a matching electrical connector or adapter to transfer electric power and at the moment that the electrical connector or adapter is detached from a matching electrical connector or adapter to interrupt the power transmission.

For example, when an electric vehicle is charged from a charging station or a utility power source, the user has to use a charging adapter carefully. The charging adapter is often used outdoor. If water or dust is entered into the charging adapter, the user may suffer from an electrical shock at the moment that the charging adapter is connected with a matching adapter or connector to transfer electric power and at the moment that the charging adapter is detached from a matching adapter or connector to interrupt the power transmission. In order to prevent water and dust from being introduced into the charging adapter when the charging adapter is not in use, the charging adapter is equipped with a cap or lid for selectively covering or uncovering the electrical contacts thereof so as to protect against water and dust to a certain degree. However, these prior arts suffer from numerous disadvantages and inconvenience. The user does not have the habit of covering the cover or lid on the opening of the charging adapter when the charging adapter is not in use. Under this circumstance, the electrical contacts of the charging adapter are exposed to the environment which may cause the electrical contacts to corrode. In addition, the user may touch the electrical contacts of the charging adapter accidently and suffer from an electrical shock. Moreover, if the user forgets to cover the opening of the charging adapter and water or moisture is entered into the charging adapter, the user may suffer from an electrical shock at the moment that the charging adapter is connected with a matching adapter or connector to transfer electric power and at the moment that the charging adapter is detached from a matching adapter or connector to interrupt the power transmission. Moreover, the prior art also fails to provide a safety structure capable of preventing accident detachment between the charging adapter and a matching adapter or connector to address the electrical shock issue.

Therefore, there is a need of providing an adapter assembly with safety design to avoid electrical shock issue and obviate the drawbacks encountered from the prior arts.

SUMMARY OF THE INVENTION

It is an object of the present disclosure to provide an adapter assembly with safety design to avoid electrical shock issue and provide waterproof and dustproof functions. The adapter assembly includes a rotating cover driven by the action of inserting the second adapter into the first adapter or pulling out the second adapter from the first adapter. When the second adapter is inserted into the first adapter, the rotating cover is driven to open and uncover the first electrical contact elements of the first adapter, so that the second adapter can match and fit with the first adapter correctly to achieve the purposes of the electrical connection and the sealing protection at the same time. When the second adapter is pulled out from the first adapter, the rotating cover is driven to close and cover the first electrical contact elements of the first adapter, so that the first adapter can be insulated completely to achieve the purposes of the insulation and the sealing protecting at the same time. The adapter assembly of the present disclosure can avoid electrical shock issue and provide waterproof and dustproof functions. Moreover, since the rotating cover is operated by an automatic action mechanism, it is labor-saving, time-saving and cost-saving to maintain the safety of utilizing the adapter assembly.

In accordance with an aspect of the present disclosure, there is provided an adapter assembly including a first adapter and a second. The first adapter includes a main body and a rotating cover. The main body includes at least one first electrical contact element, and the rotating cover is pivotally connected with the main body and rotated between a first position and a second position relative to the main body. The rotating cover includes at least one first through hole and at least one protruding pin. When the rotating cover is rotated to the first position, the at least one first through hole and the at least one first electrical contact element are misaligned with each other. When the rotating cover is rotated to the second position, the at least one first through hole and the least one first electrical contact element are aligned with each other. The second adapter is matched with the first adapter and includes at least one second electrical contact element, an accommodation space and at least one guiding groove. The at least one second electrical contact element is disposed within the accommodation space, and the at least one guiding groove is disposed on an inner wall of the accommodation space. When the first adapter and the second adapter are matched with each other, the at least one guiding groove abuts against the at least one protruding pin of the rotating cover to drive the rotating cover to rotate from the first position to the second position, the at least one second electrical contact element is aligned to the at least one first through hole and the at least one first electrical contact element, and the at least one second electrical contact element and the at least one first electrical contact element are electrically connected with each other.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
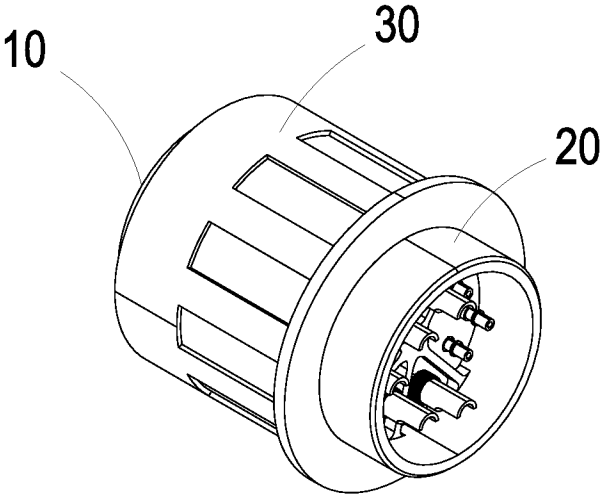
FIG. 1 is a schematic perspective view illustrating an adapter assembly including a first adapter and a second adapter matched with each other according to a first embodiment of the present disclosure.
Figure 2:
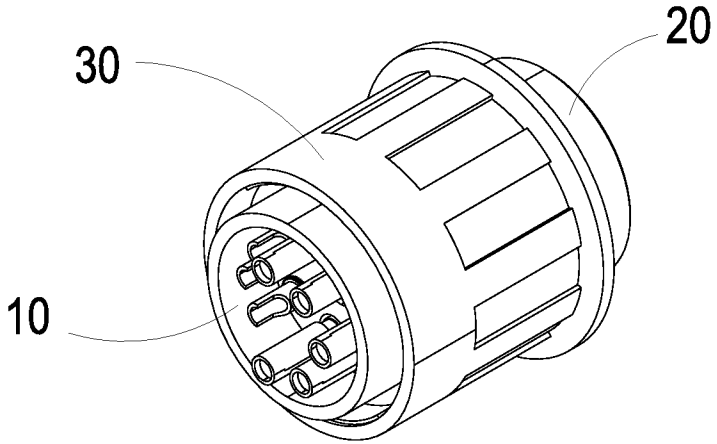
FIG. 2 is a schematic perspective view illustrating the adapter assembly including the first adapter and the second adapter matched with each other according to the first embodiment of the present disclosure and taken at a different observation angle.
Figure 3:
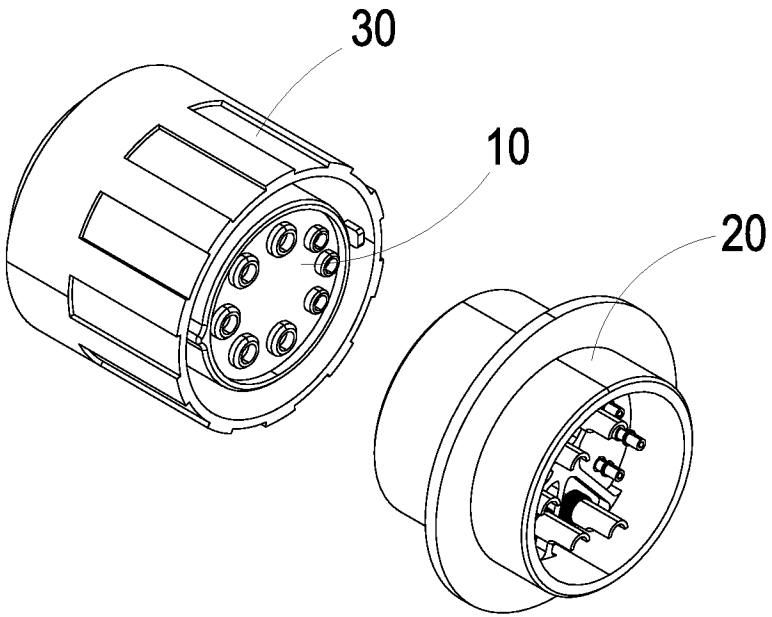
FIG. 3 is a schematic perspective view illustrating the adapter assembly including the first adapter and the second adapter separated from each other according to the first embodiment of the present disclosure.
Figure 4:
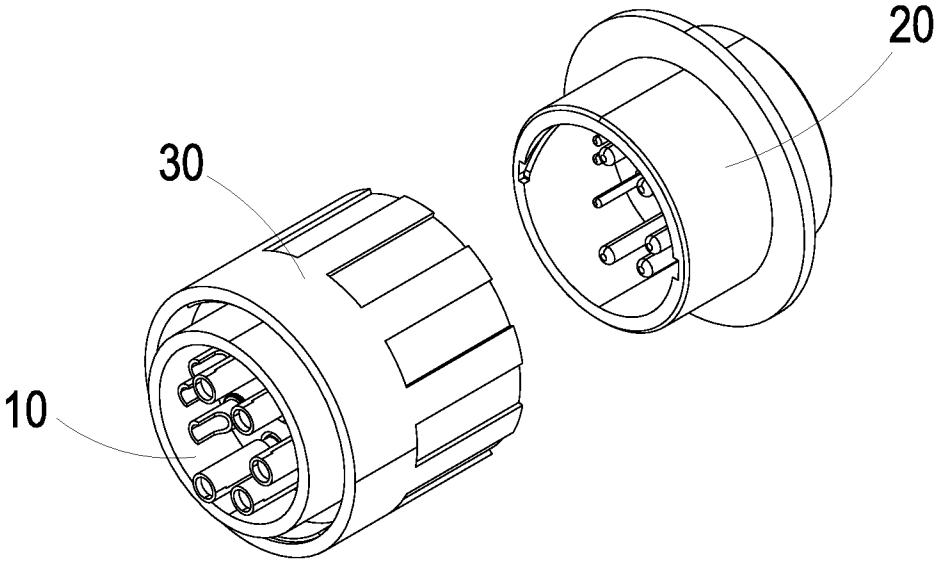
FIG. 4 is a schematic perspective view illustrating the adapter assembly including the first adapter and the second adapter separated from each other according to the first embodiment of the present disclosure and taken at a different observation angle.
Figure 5:
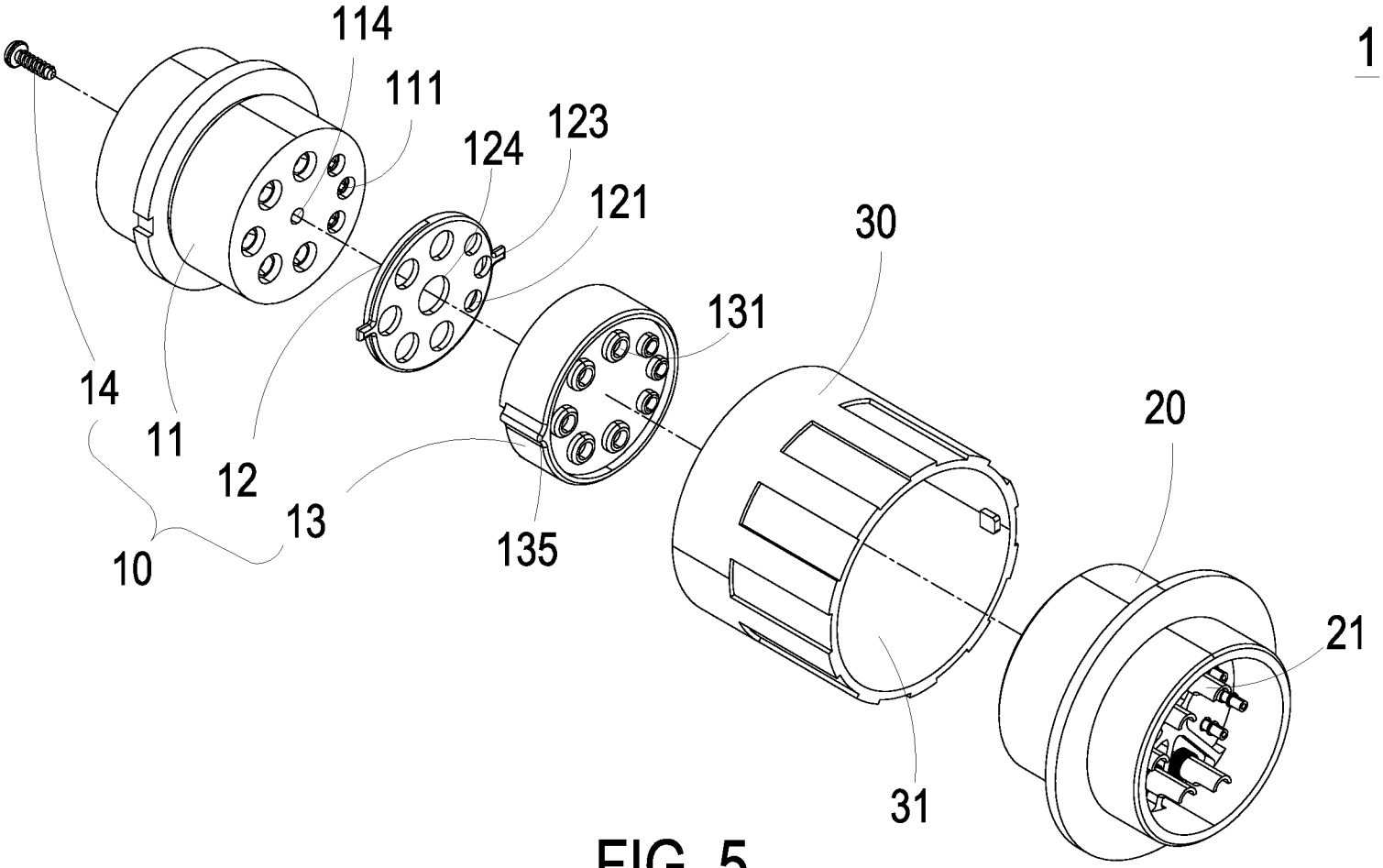
FIG. 5 is an explored view showing the adapter assembly according to the first embodiment of the present disclosure.
Figure 6:
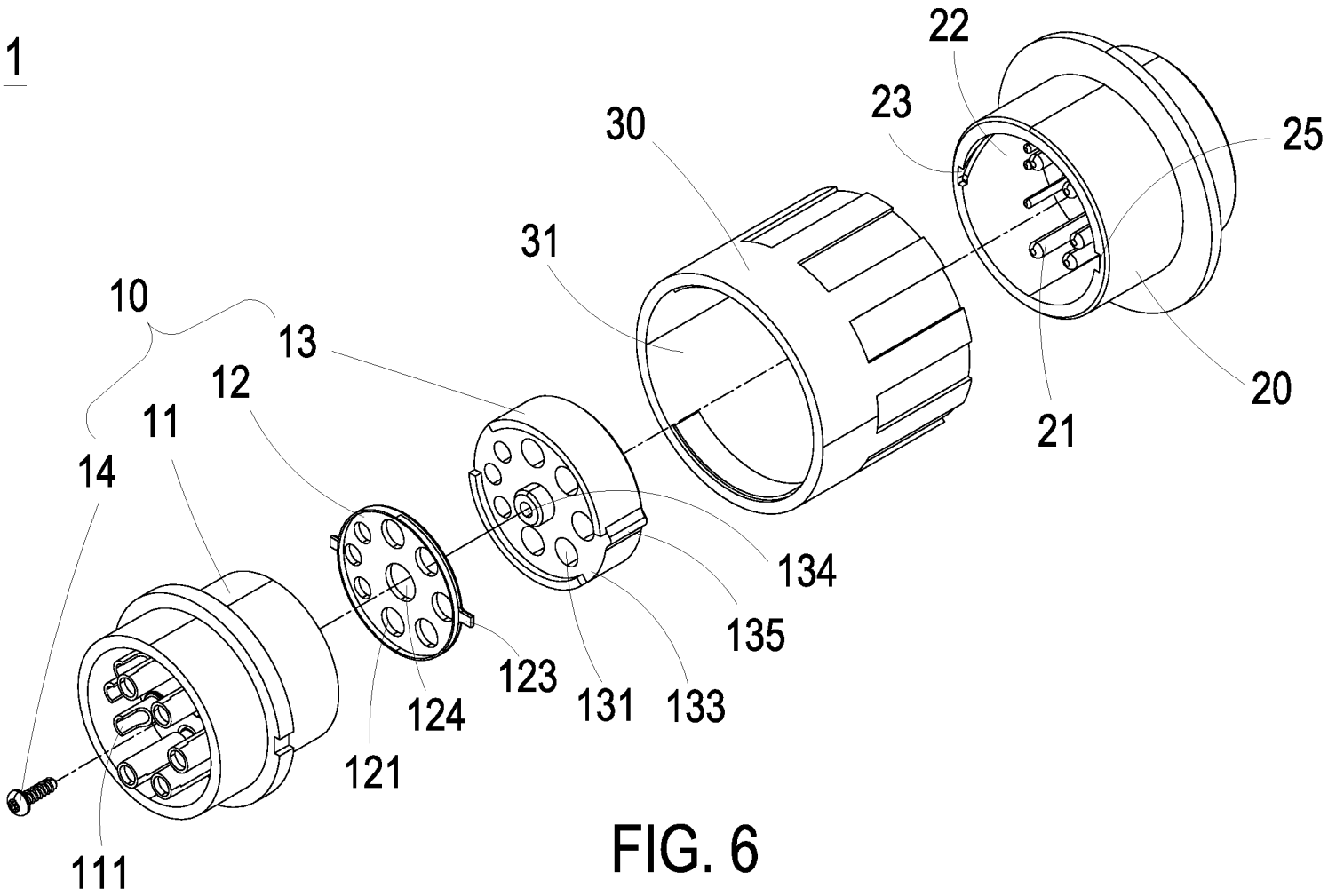
FIG. 6 is an explored view showing the adapter assembly according to the first embodiment of the present disclosure and taken at a different observation angle.

FIGS. 1 and 2 are schematic perspective views illustrating an adapter assembly including a first adapter and a second adapter matched with each other according to a first embodiment of the present disclosure. FIGS. 3 and 4 are schematic perspective view illustrating the adapter assembly including the first adapter and the second adapter separated from each other according to the first embodiment of the present disclosure. FIGS. 5 and 6 are explored views showing the adapter assembly according to the first embodiment of the present disclosure. As shown in FIGS. 1 to 6, the adapter assembly 1 includes a first adapter 10, a second adapter 20 and an outer ring 30. In the embodiment, the first adapter 10 and the second adapter 20 can be for example a female adapter and a male adapter, respectively, which are matched with each other. The first adapter 10 includes a main body 11, a rotating cover 12, a front cover 13 and a fastening element 14. The main body 11 includes at least one first electrical contact element 111 and a first fastening hole 114 running through the main body 11. The rotating cover 12 is pivotally connected with the main body 11, and capable of rotating between a first position and a second position at a specific angle relative to the main body 11 for example along a clockwise or counterclockwise direction. The rotating cover 12 includes at least one first through hole 121, a protruding pin 123 and a central opening 124. The at least one first through hole 121 is disposed and spatially corresponding to the at least one first electrical contact element 111 of the main body 11. The central opening 124 is disposed and spatially corresponding to the first fastening hole 114 of the main body 11. The protruding pin 123 is disposed adjacent to the outer edge of the rotating cover 12 and protruded outwardly from the rotating cover 12. The front cover 13 includes at least one second through hole 131, a recess 133, a second fastening hole 134 and a first positioning element 135. The at least one second through hole 131 is disposed and spatially corresponding to the at least one first through hole 121 of the rotating cover 12 and the at least one first electrical contact element 111 of the main body 11. The recess 133 is disposed adjacent to the outer edge of the front cover 13 and spatially corresponding to the protruding pin 123 of the rotating cover 12. The second fastening hole 134 is disposed and spatially corresponding to the central opening 124 of the rotating cover 12 and the first fastening hole 114 of the main body 11. In the embodiment, the fastening element 14 can be for example but not limited to a screw, and the first fastening hole 114 and the second fastening hole 134 can be for example but not limited to a screw hole, respectively. The main body 11, the rotating cover 12 and the front cover 13 are stacked sequentially with each other and the front cover 13 is fastened on the main body 11 by the fastening element 14 located through the first fastening hole 114, the central opening 124 and the second fastening hole 134, so as to form the first adapter 10. Consequently, the rotating cover 12 is pivotally connected with the main body 11 through the fastening element 14.

In the embodiment, the fastening element 14 passes through the first fastening hole 114 of the main body 11, the central opening 124 of the rotating cover 12 and the second fastening hole 134 of the front cover 13, and engages with the first fastening hole 114 and the second fastening hole 134, so as to form the structure of the first adapter 10. The first positioning element 135 is disposed on the outer wall of the front cover 13.

It is noted that the rotating cover 12 is clamped between the main body 11 and the front cover 13. Furthermore, the main body 11 and the front cover 13 are fixed with each other, and the rotating cover 12 is pivotally connected with the main body 11 and the front cover 13 so that the rotating cover 12 is rotatable relative to the main body 11 and the front cover 13 along a clockwise or counterclockwise direction. Since the protruding pin 123 is spatially corresponding to the recess 133 of the front cover 13, the protruding pin 123 of the rotating cover 12 runs through the recess 133 and is exposed and uncovered between the main body 11 and the front cover 13 while the rotating cover 12 is rotated relative to the main body 11 and the front cover 13. On the other hand, in order to facilitate the rotating cover 12 to rotate smoothly relative to the main body 11 and the front cover 13, the rotating cover 12 can be made of a polytetrafluoroethylene (also called as Teflon) material, but not limited thereto.

In the embodiment, the second adapter 20 can be matched with the first adapter 10 to achieve an electrical connection. The second adapter 20 includes at least one second electrical contact element 21, an accommodation space 22, a guiding groove 23 and a second positioning element 25. The at least one second electrical contact element 21 is disposed within the accommodation space 22. While the second adapter 20 and the first adapter 10 are matched with each other, the at least one second electrical contact element 21 passes through the at least one second through hole 131 of the front cover 13, the at least one first through hole 121 of the rotating cover 12 and is engaged with the at least one first electrical contact element 111 of the main body 11, so as to be electrically connected with the at least one first electrical contact element 111. At the same time, the front cover 13, the rotating cover 12 and a part of the main body 11 of the first adapter 10 are received within the accommodation space 22 of the second adapter 20. In some embodiments, portion of the first adapter 10 is press-fitted into the second adapter 20. The guiding groove 23 is spatially corresponding to the protruding pin 123 of the rotating cover 12, disposed within the accommodation space 22 and located on the inner wall the accommodation space 22 of the second adapter 20. Preferably, the guiding groove 23 is inclined from the opening end of the accommodation space 22 of the second adapter 20 and disposed on the inner wall of the accommodation space 22 of the second adapter 20. When the second adapter 20 tends to insert into the first adapter 10 for allowing the at least one second electrical contact element 21 of the second adapter 20 to contact with the at least one first electrical contact element 111 of the first adapter 10, the lateral wall of the guiding groove 23 abuts against the protruding pin 123 of the rotating cover 12 to drive the rotating cover 12 to rotate relative to the main body 11 and the front cover 13 along a path. Namely, the protruding pin 123 of the rotating cover 12 is moved along the guiding groove 23 of the second adapter 20. Consequently, the at least one first through hole 121 of the rotating cover 12 is aligned with the at least one first electrical contact element 111 of the first adapter 10, the at least one second electrical contact element 21 of the second adapter 20 and the at least one second through hole 131 of the front cover 13. The electrical connection between the first adapter 10 and the second adapter 20 is achieved.

On the other hand, when the second adapter 20 tends to be detached from the first adapter 10 for allowing the at least one second electrical contact element 21 of the second adapter 20 to separate from the at least one first electrical contact element 111 of the first adapter 10, the lateral wall of the guiding groove 23 abuts against the protruding pin 123 of the rotating cover 12 to drive the rotating cover 12 to rotate relative to the main body 11 and the front cover 13 and back to the original position. Consequently, the at least one first through hole 121 of the rotating cover 12 is misaligned with the at least one first electrical contact element 111 of the first adapter 10 and the at least one second through hole 131 of the front cover 13. The sealing protection of the at least one first electrical contact element 111 of the first adapter 10 is achieved by the rotating cover 12. The action mechanism will be described as follows.

In the embodiment, the outer ring 30 is disposed around the first adapter 10 and includes a receiving opening 31. When the second adapter 20 and the first adapter 10 are matched with each other, the connection part of the second adapter 20 and the first adapter 10 can be received in the receiving opening 31 of the outer ring 30, so as to achieve the protection effect. In some embodiments, the outer ring 30 further includes an engaging element (not shown) to engage with the second adapter 20, when the second adapter 20 and the first adapter 10 are matched with each other. Consequently, the second adapter 20 and the first adapter 10 are locked together by the outer ring 30 so that accident detachment between the second adapter 20 and the first adapter 10 can be prevented. On the other hand, with the outer ring 30 disposed around the first adapter 10, the main body 11 and the rotating cover 12 are both received within the receiving opening 31. The at least one protruding pin 123 is protruded from the outer edge of the main body 11 but not protruded from the receiving opening 31. In this way, it ensures that the at least one protruding pin 123 is guided by the at least one guiding groove 23 only when the second adapter 20 is matched with the first adapter 10, so as to avoid an accidental touch of users. In other embodiment, the outer ring 30 can be omitted. The present disclosure is not limited thereto and not redundantly described herein.

Figure 8:
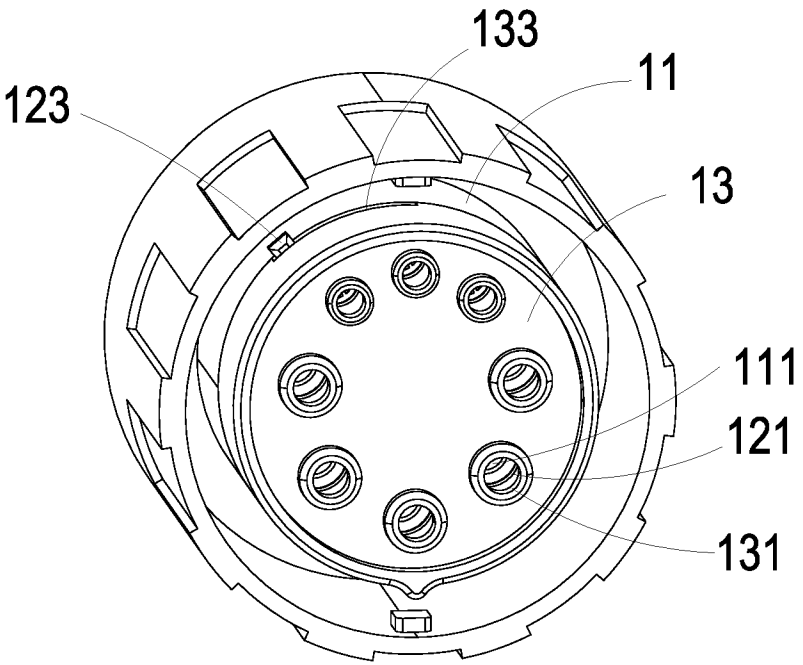
FIG. 8 is a schematic perspective view showing the first adapter including the rotating cover located at a second position according to the first embodiment of the present disclosure.
Figure 7:
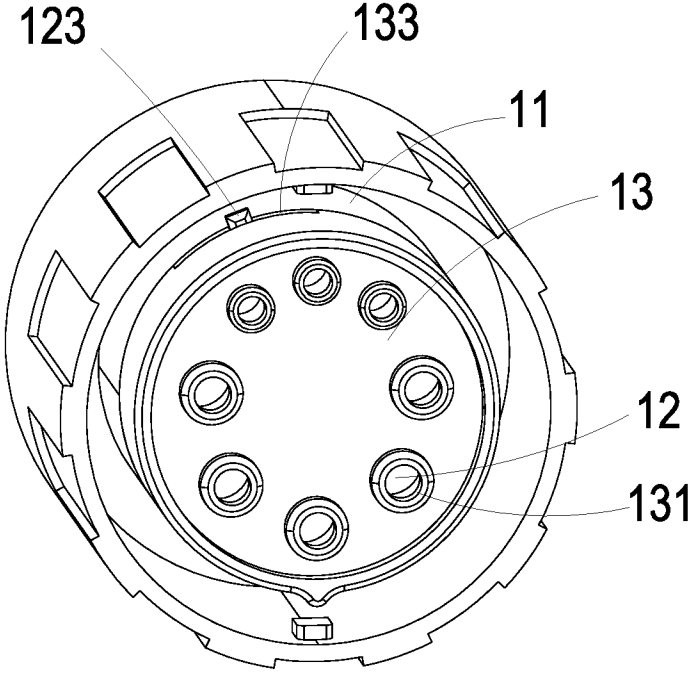
FIG. 7 is a schematic perspective view showing the first adapter including the rotating cover located at a first position according to the first embodiment of the present disclosure.
Figure 10:
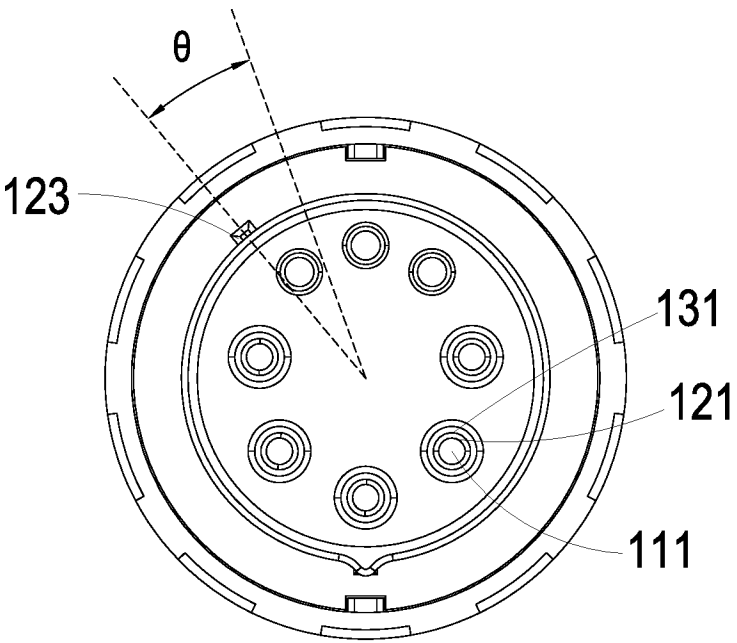
FIG. 10 is a front view of FIG. 8.
Figure 9:
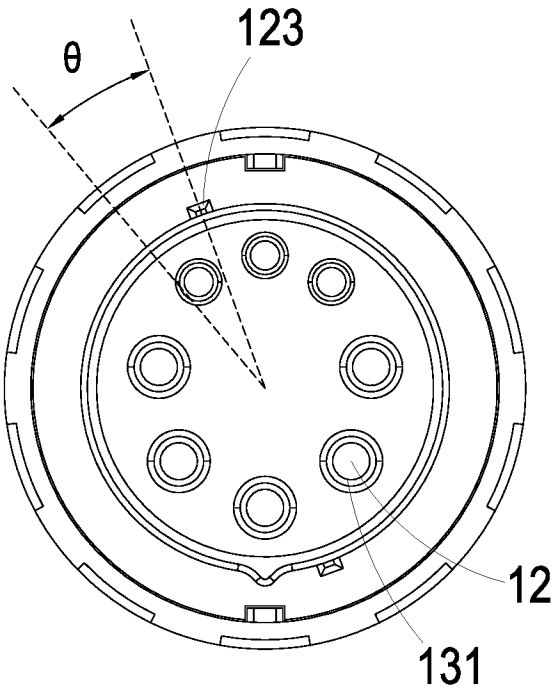
FIG. 9 is a front view of FIG. 7.
Figure 12:
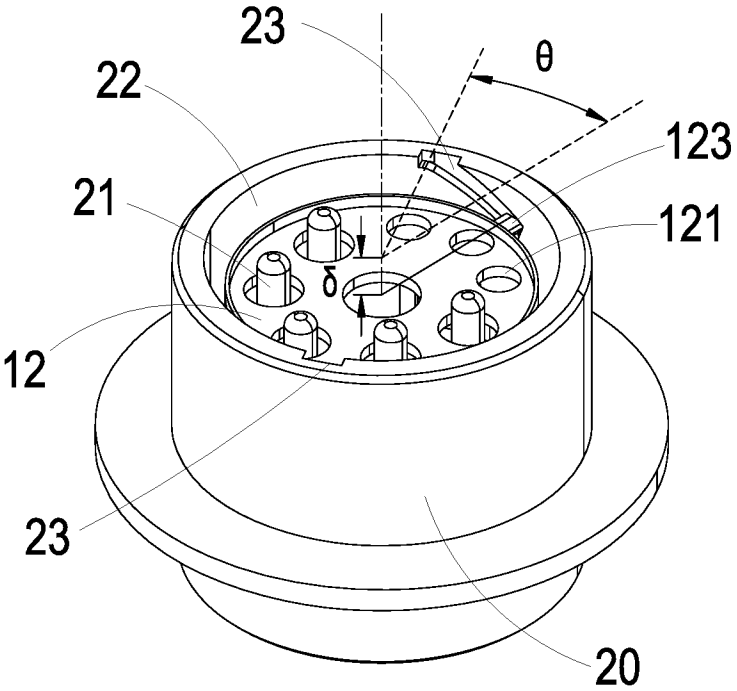
FIG. 12 is a schematic perspective view showing the relationship between the second adapter and the rotating cover while the rotating cover is located at the second position according to the first embodiment of the present disclosure.
Figure 11:
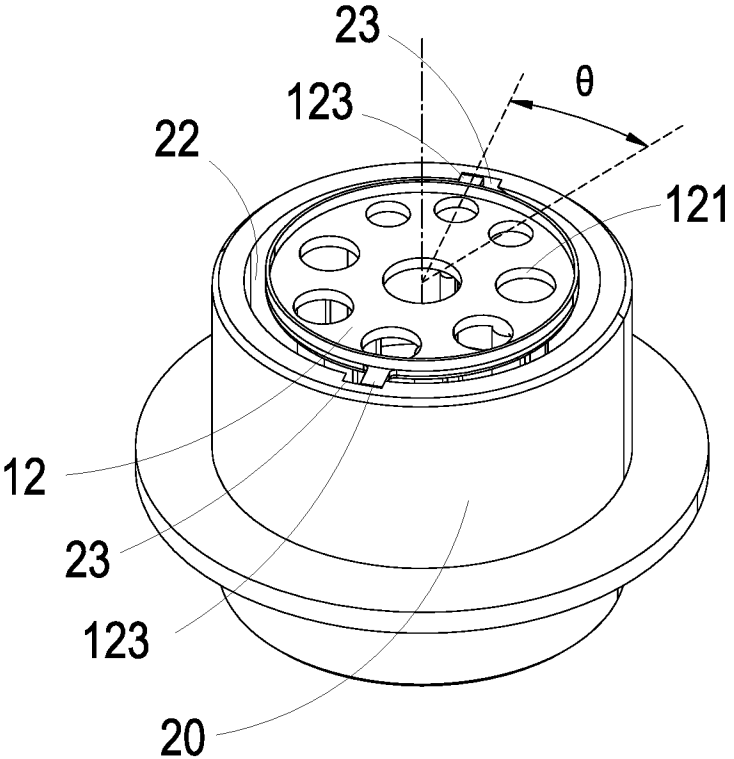
FIG. 11 is a schematic perspective view showing the relationship between the second adapter and the rotating cover while the rotating cover is located at the first position according to the first embodiment of the present disclosure.

Please further refer to FIGS. 7 to 12. FIG. 7 is a schematic perspective view showing the first adapter including the rotating cover located at a first position according to the first embodiment of the present disclosure. FIG. 8 is a schematic perspective view showing the first adapter including the rotating cover located at a second position according to the first embodiment of the present disclosure. FIG. 9 is a front view of FIG. 7. FIG. 10 is a front view of FIG. 8. FIG. 11 is a schematic perspective view showing the relationship between the second adapter and the rotating cover while the rotating cover is located at the first position according to the first embodiment of the present disclosure. FIG. 12 is a schematic perspective view showing the relationship between the second adapter and the rotating cover while the rotating cover is located at the second position according to the first embodiment of the present disclosure. In the embodiment, the rotating cover 12 is rotated at a specific angle θ between a first position (referring to FIGS. 7 and 9) and a second position (referring to FIGS. 8 and 10). When the second adapter 20 tends to insert into the first adapter 10 for allowing the at least one second electrical contact element 21 of the second adapter 20 to contact with the at least one first electrical contact element 111 of the first adapter 10, the at least one second electrical contact element 21 has to pass through the at least one second through hole 131 of the front cover 13, the at least one first through hole 121 of the rotating cover 12 and then engages with the at least one first electrical contact element 111 of the main body 11, so as to achieve the electrical connection.

With the action of inserting the second adapter 20 into the first adapter 10 for allowing the at least one second electrical contact element 21 of the second adapter 20 to contact with the at least one first electrical contact element 111 of the first adapter 10, the guiding groove 23 disposed on the inner wall of the second adapter 20 abuts against the protruding pin 123 of the rotating cover 12 to drive the rotating cover 12 to rotate relative to the main body 11 and the front cover 13. Consequently, the rotating cover 12 is driven to rotate and move from the first position (referring to FIGS. 7 and 9) to the second position (referring to FIGS. 8 and 10) and moved along the guiding groove 23 of the second adapter 20. The at least one first through hole 121 of the rotating cover 12 is rotated to align with the at least one second through hole 131 of the front cover 13 and the at least one first electrical contact element 111, and the at least one second electrical contact element 21 can contact with the at least one first electrical contact element 111 directly. In the embodiment, the first electrical contact element 111 and the second electrical contact element 21 can be, for example, a female conductive terminal and a male conductive terminal, respectively, which are matched with each other, but the present disclosure is not limited thereto.

Alternatively, with the action of detaching the second adapter 20 from the first adapter 10 for allowing the at least one second electrical contact element 21 of the second adapter 20 to separate from the first electrical contact element 111 of the first adapter 10, the guiding groove 23 disposed on the inner wall of the second adapter 20 abuts against the protruding pin 123 of the rotating cover 12 to drive the rotating cover 12 to rotate and move from the second position (referring to FIGS. 8 and 10) to the first position (referring to FIGS. 7 and 9). The protruding pin 123 of the rotating cover 12 is moved along the guiding groove 23 of the second adapter 20. Meanwhile, the at least one first through hole 121 of the rotating cover 12 is rotated to misalign with the at least one second through hole 131 of the front cover 13 and the at least one first electrical contact element 111, so as to insulate the communication between the at least one first electrical contact element 111 and the at least one second through hole 131 of the front cover 13. Namely, after the second adapter 20 and the first adapter 10 are separated from each other, the rotating cover 12 is rotated to seal the at least one first electrical contact element 111 of the first adapter 10.

On the other hand, in response to the motion of connecting the second adapter 20 with the first adapter 10, the protruding pin 123 of the rotating cover 12 is moved along the guiding groove 23 of the second adapter 20. Under this circumstance, the rotating cover 12 is rotated at the specific angle θ from the first position (referring to FIG. 11) to the second position (referring to FIG. 12) and moved at a specific depth δ relative to the second adapter 20. It allows the at least one second electrical contact element 21 of the second adapter 20 to pass through the at least one first through hole 121 of the rotating cover 12, so as to further connect with the at least one first electrical contact element 111 of the first adapter 10. Alternatively, in response to the motion of detaching the second adapter 20 from the first adapter 10, the rotating cover 12 is rotated at the specific angle θ from the second position (referring to FIG. 12) to the first position (referring to FIG. 11) and separated from the second adapter 20. Namely, the motion of the rotating cover 12 is controlled by the actions of the second adapter 20 having the guiding groove 23 abutting against the protruding pin 123 of the rotating cover 12. The motion path of the rotating cover 12 relative to the second adapter 20 is adjustable by changing the design of the guiding groove 23. In an embodiment, the first adapter 10 includes for example a spring (not shown) connected with the rotating cover 12 to maintain the rotating cover 12 at the first position. When the second adapter 20 is moved and the guiding groove 23 abuts against the protruding pin 123 of the rotating cover 12, it is easy to drive the rotating cover 12 against the maintain force of the spring. When the second adapter 20 is separated from the first adapter 10, the maintain force of the spring can make sure that the rotating cover 12 is maintained at the first position. Certainly, it is not an essential feature of the present disclosure and not redundantly described herein.

In some embodiments, the front cover 13 can be omitted and the rotating cover 12 is pivotally connected to the main body 11. The rotating cover 12 is rotatable with respect to the main body 11. The present disclosure is not limited thereto. In the embodiment, the front cover 13 has a specific thickness so as to provide a safety distance, such as example the creepage distance. The thickness of the front cover 13 is adjustable according to the practical requirement. Certainly, it is not an essential feature of the present disclosure and not redundantly described herein.

Please refer to FIG. 6 again. For facilitating the motion of the second adapter 20 relative to the first adapter 10, the second adapter 20 and the first adapter 10 can further include a positioning element, respectively. In the embodiment, the first adapter 10 includes a first positioning element 135 disposed on the outer wall of the front cover 13, and the second adapter 20 includes a second positioning element 25 disposed on the inner wall of the accommodation space 22 of the second adapter 20. The first positioning element 135 is spatially corresponding to the second positioning element 25. Preferably but not exclusively, the first positioning element 135 and the second positioning element 25 are a protrusion and a recess, respectively. When the first adapter 10 and the second adapter 20 are matched with each other, the first positioning element 135 and the second positioning element 25 are aligned and engaged with each other, so as to facilitate the user to insert the second adapter 20 into the first adapter 10. With the arrangement of the first positioning element 135 and the second positioning element 25, the user can insert the second adapter 20 into the first adapter 10 easily. Certainly, the present disclosure is not limited thereto and not redundantly described herein.

Moreover, in the embodiment, the rotating cover 12 includes two protruding pins 123 opposite to each other and symmetrically disposed around the edge thereof. The second adapter 20 includes two guiding grooves 23 opposite to each other, symmetrically disposed on the inner wall thereof and spatially corresponding to two protruding pins 123 of the rotating cover 12. With the symmetrical arrangement of the protruding pins 123 and the guiding grooves 23, it facilitates the rotating cover 12 to move stably relative to the second adapter 20. It is noted that the number and the arrangement of the protruding pin 123 and the guiding groove 23 are adjustable according to the practical requirements, and not redundantly described herein.

The adapter assembly 1 is applicable to various fields for conveying electric power from a power supplying end to a power receiving end. In an embodiment, the adapter assembly 1 including a first adapter 10 and a second adapter 20 can be used for transferring electric power from a charging station or a utility power source to a battery mounted in an electric vehicle or a hybrid electric vehicle. In some embodiments, the adapter assembly 1 including an industrial plug and a socket can be used for transferring power from a power source to an electrical equipment. It is noted that the adapter assembly 1 is not limited to the above embodiments and can be varied according to the practical requirements.

In accordance with the concept of the present disclosure, the first electrical contact element 111 of the first adapter 10 is covered by the rotating cover 12 when the first adapter 10 is not in use or when the second adapter 20 is detached from the first adapter 10. The first electrical contact element 111 of the first adapter 10 is uncovered by the rotating cover 12 at the moment when the second adapter 20 is fitted with the first adapter 10. Consequently, the first adapter 10 and the second adapter 20 can prevent electrical shock issue and provide waterproof and dustproof functions without using additional cover. Preferably but not exclusively, the structure of the first adapter 10 and the adapter assembly 1 are waterproof and dustproof and in complying with the IP 24 class of protection of the IEC/EN 60529 standard of the international Electrotechnical Commission.

Figure 13:
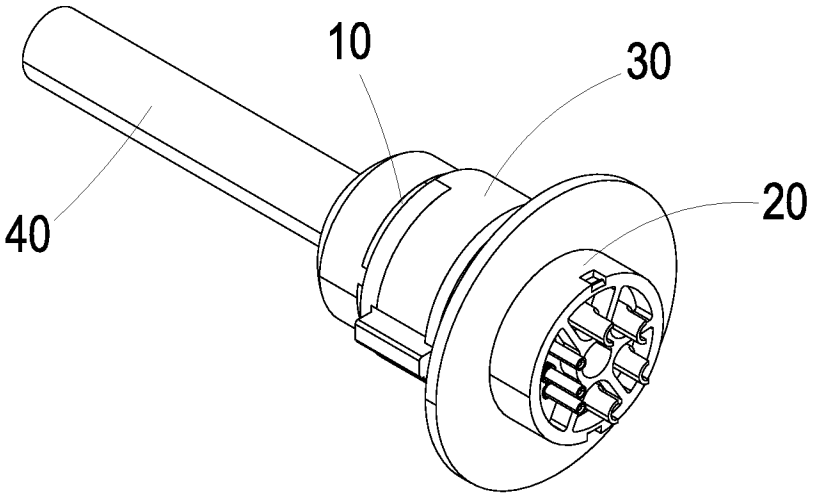
FIG. 13 is a schematic perspective view illustrating an adapter assembly including a first adapter and a second adapter matched with each other according to a second embodiment of the present disclosure.
Figure 14:
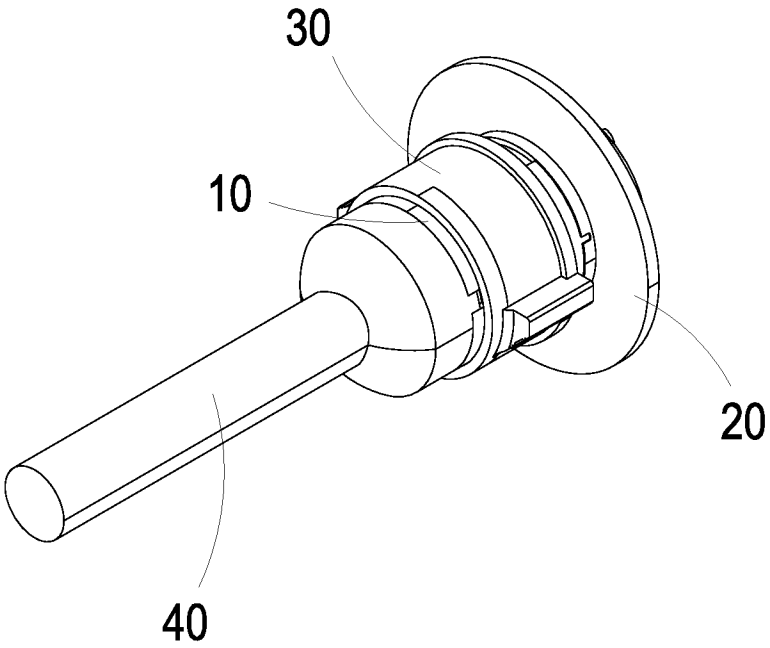
FIG. 14 is a schematic perspective view illustrating the adapter assembly including the first adapter and the second adapter matched with each other according to the second embodiment of the present disclosure and taken at a different observation angle.
Figure 15:
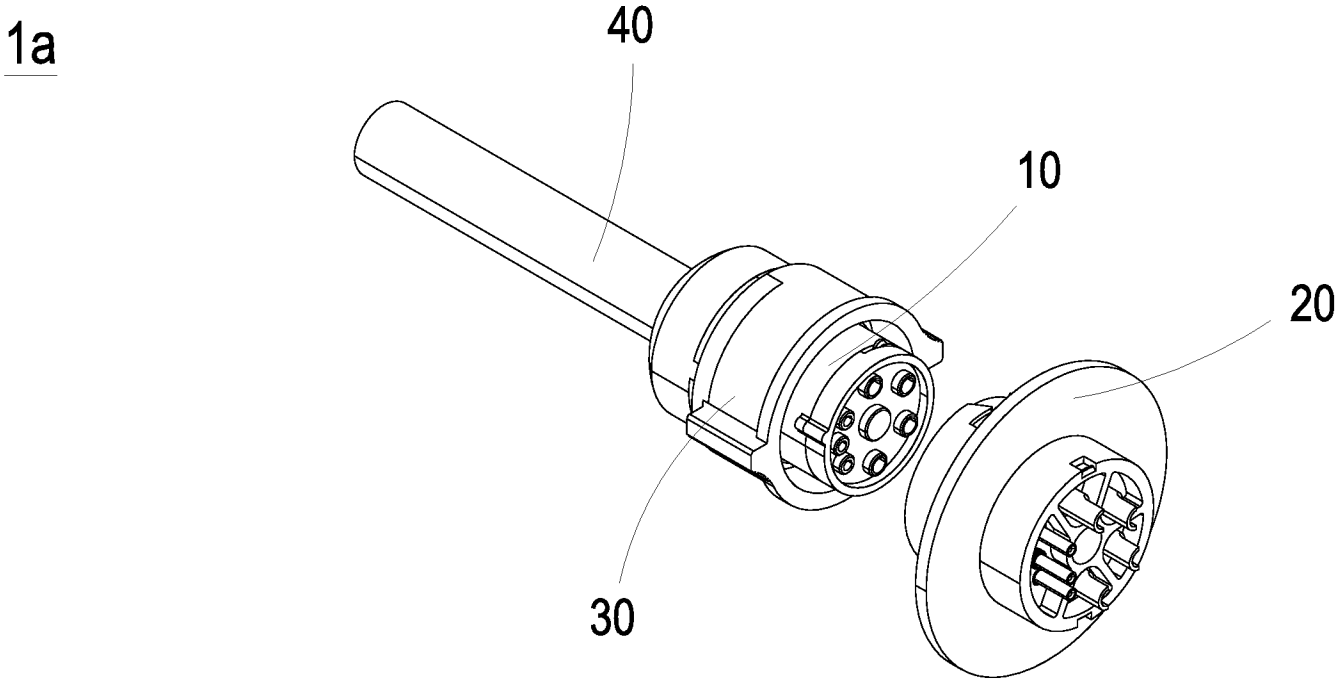
FIG. 15 is a schematic perspective view illustrating the adapter assembly including the first adapter and the second adapter separated from each other according to the second embodiment of the present disclosure.
Figure 16:
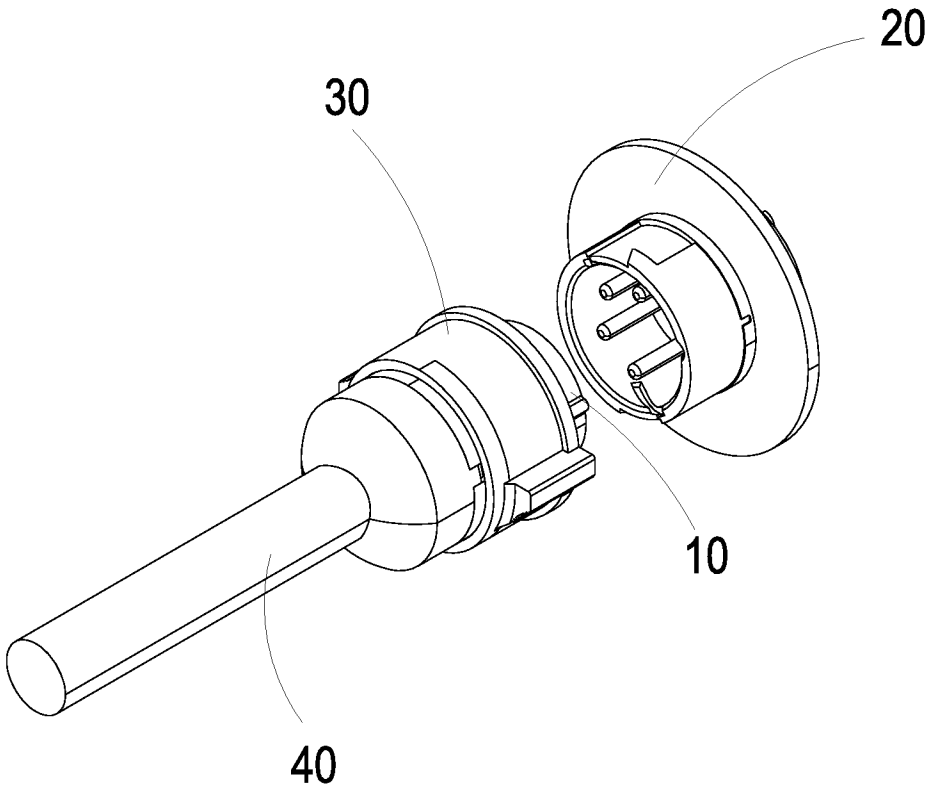
FIG. 16 is a schematic perspective view illustrating the adapter assembly including the first adapter and the second adapter separated from each other according to the second embodiment of the present disclosure and taken at a different observation angle.
Figure 17:
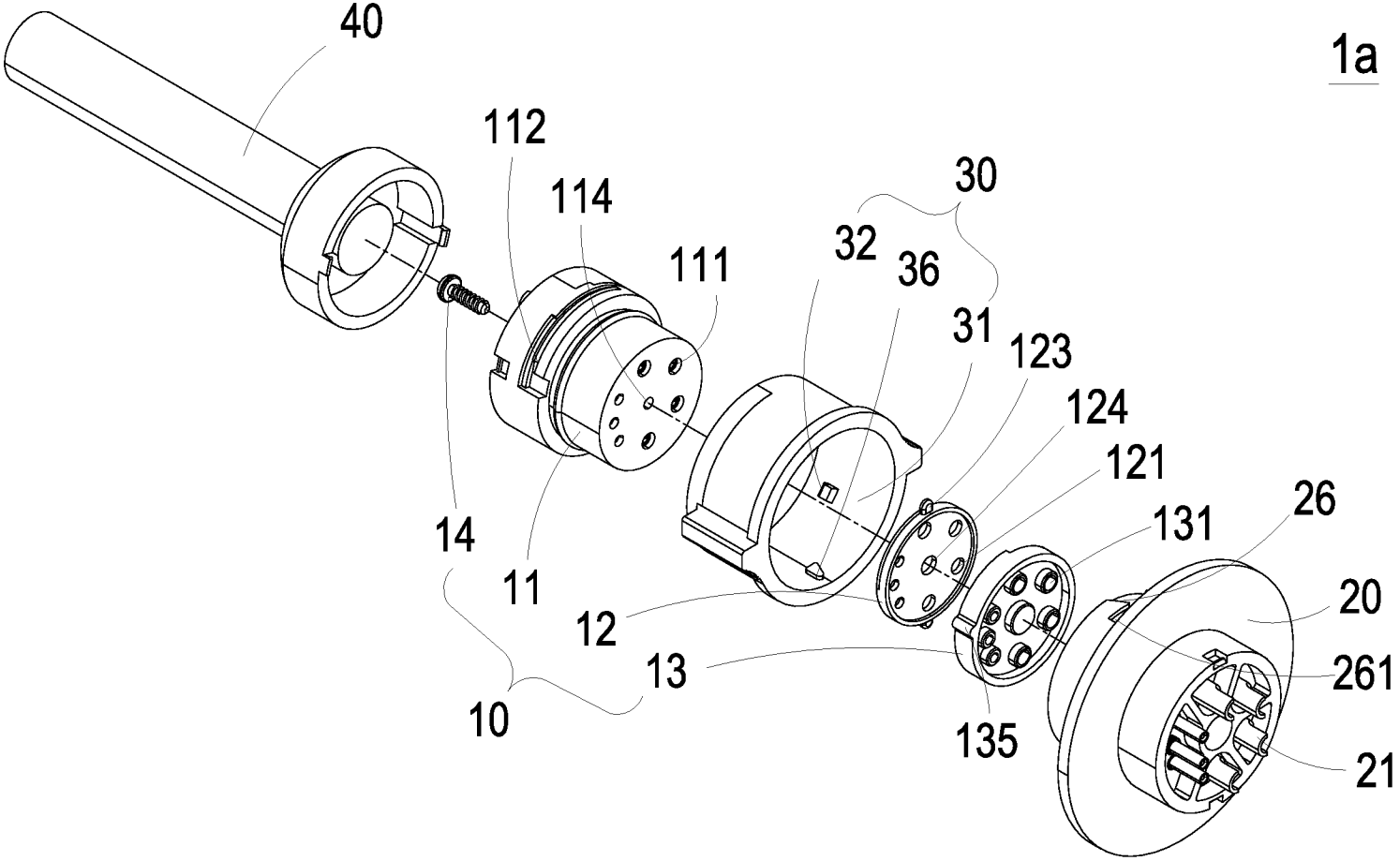
FIG. 17 is an explored view showing the adapter assembly according to the second embodiment of the present disclosure.
Figure 18:
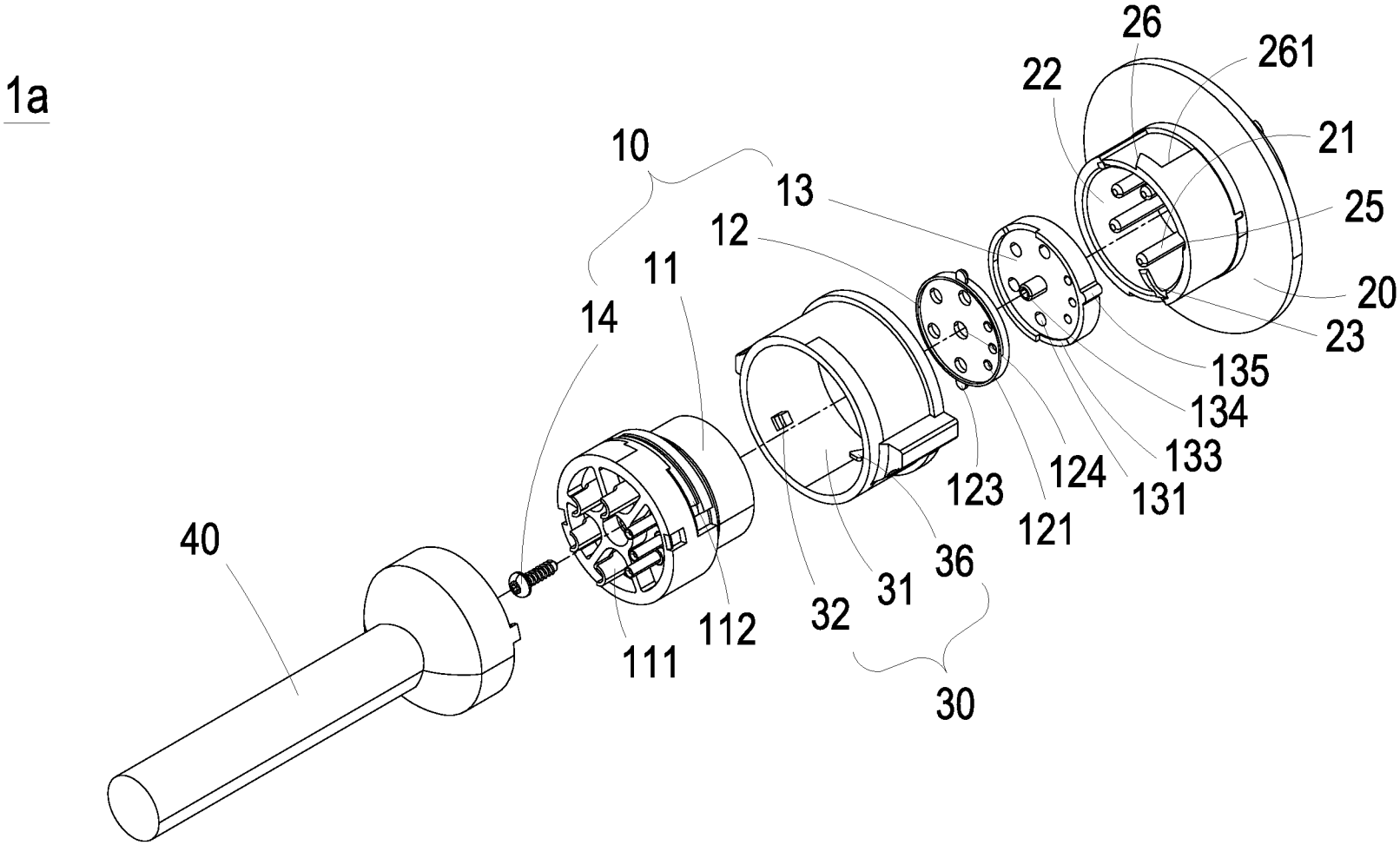
FIG. 18 is an explored view showing the adapter assembly according to the second embodiment of the present disclosure and taken at a different observation angle.

Please refer to FIGS. 13 to 18. FIGS. 13 and 14 are schematic perspective views illustrating an adapter assembly including a first adapter and a second adapter matched with each other according to a second embodiment of the present disclosure. FIGS. 15 and 16 are schematic perspective views illustrating the adapter assembly including the first adapter and the second adapter separated from each other according to the second embodiment of the present disclosure. FIGS. 17 and 18 are explored views showing the adapter assembly according to the second embodiment of the present disclosure. In the embodiment, the structures, elements and functions of the adapter assembly 1*a* are similar to those of the adapter assembly 1 in FIGS. 1 to 6, and are not redundantly described herein. In the embodiment, the adapter assembly 1*a* includes a first adapter 10, a second adapter 20, an outer ring 30 and a wire assembly 40. The first adapter 10 is combined with the wire assembly 40 and the outer ring 30 is disposed around the first adapter 10. The main body 11 further includes an elastic member 112 disposed on the outer wall thereof. The outer ring 30 further includes an engaging pin 32 and a latching pin 36 disposed on the inner wall thereof. The second adapter 20 further includes a latching element 26 disposed on the outer wall thereof. The engaging pin 32 of the outer ring 30 is spatially corresponding to the elastic member 112 of the main body 11 of the first adapter 10. When the outer ring 30 is fit around the main body 11 of the first adapter 10, the elastic member 112 abuts against the engaging pin 32 to make the outer ring 30 limited in a fixed position relative to the first adapter 10. Meanwhile, the outer ring 30 is rotatable relative to the first adapter 10 in a specific range, if a force is provided to push against the elasticity force of the elastic member 112 abutting against the engaging pin 32. In the embodiment, when the second adapter 20 is inserted into the first adapter 10, the lateral wall of the guiding groove 23 abuts against the protruding pin 123 of the rotating cover 12, so as to drive the rotating cover 12 to rotate relative to the main body 11 and the front cover 13. At the same time, the latching element 26, for example an inclined plane, abuts the latching pin 36 to provide the force pushing against the elasticity force of the elastic member 112 abutting against the engaging pin 32. When the outer ring 30 is limited in the fixed position, the latching pin 36 is slid into for example a recess portion 261 of the latching element 26. Consequently, the latching pin 36 and the latching element 26 are engaged with each other, and the second adapter 20 is latched on the first adapter 10 by the outer ring 30 to avoid the separation of the first adapter 10 and the second adapter 20. In this way, the safety of utilizing the adapter assembly 1*a* is enhanced. When the user tends to detach the second adapter 20 from the first adapter 10 and pull out the second adapter 20, the user has to rotate the outer ring 30 to push against the elasticity force of the elastic member 112 abutting against the engaging pin 32 and unlatches the latching pin 36 out of the recess portion 261 of the latching element 26. Then, the second adapter 20 is allowed to be pulled out from the first adapter 10. Consequently, the rotating cover 12 is rotated to cover the at least one first electrical contact element 111 of the first adapter 10 by the action mechanism described as the above. It is noted that the action mechanism between the guiding groove 23 of the second adapter 20 and the rotating cover 12 of the first adapter 10 can be further enhanced and combined with the latching mechanism between the outer ring 30 and the second adapter 20, but the present disclosure is not limited thereto and not redundantly described herein.

Figure 20:
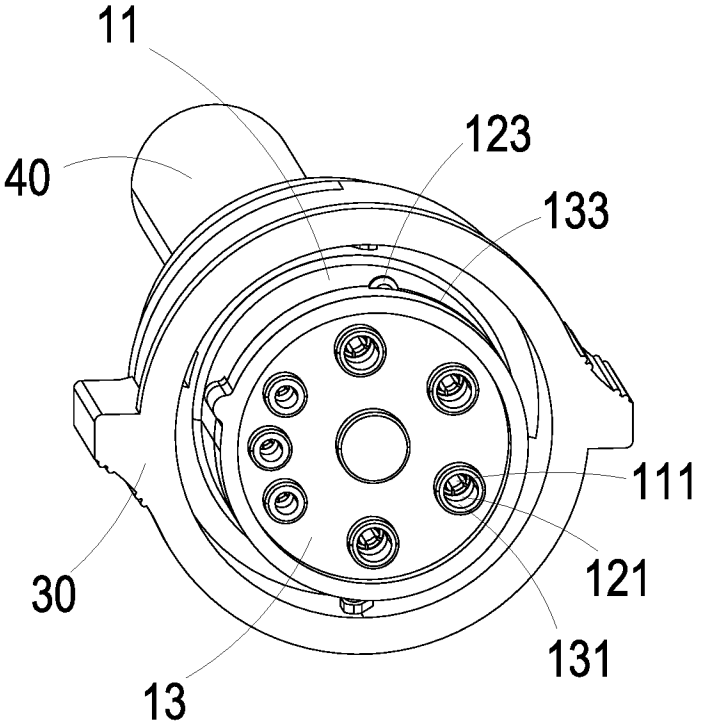
FIG. 20 is a schematic perspective view showing the first adapter including the rotating cover located at a second position according to the second embodiment of the present disclosure.
Figure 19:
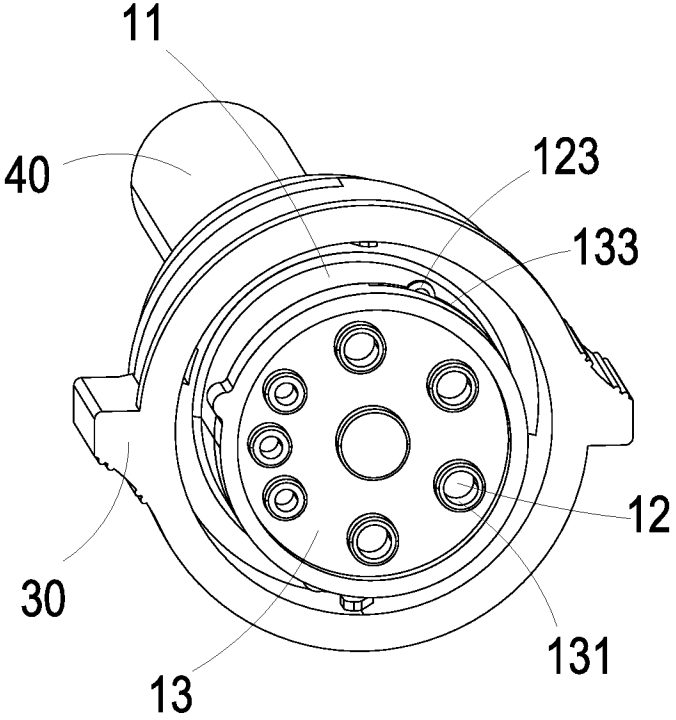
FIG. 19 is a schematic perspective view showing the first adapter including the rotating cover located at a first position according to the second embodiment of the present disclosure.
Figure 22:
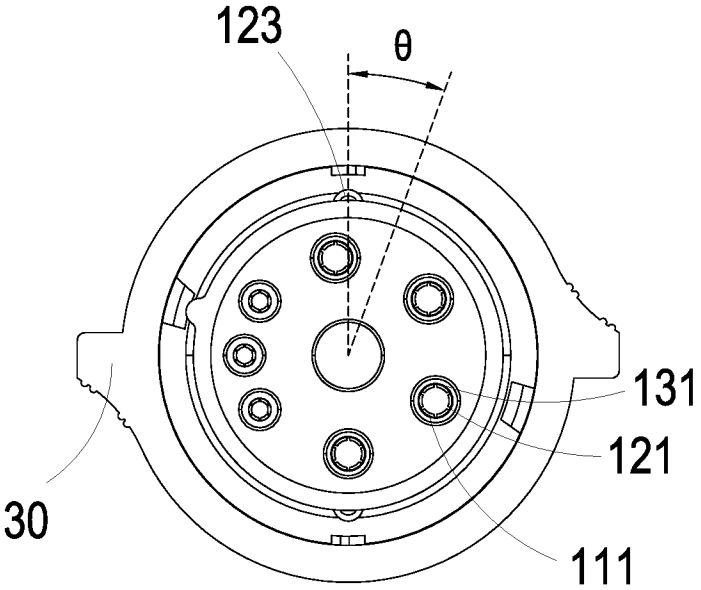
FIG. 22 is a front view of FIG. 20.
Figure 21:
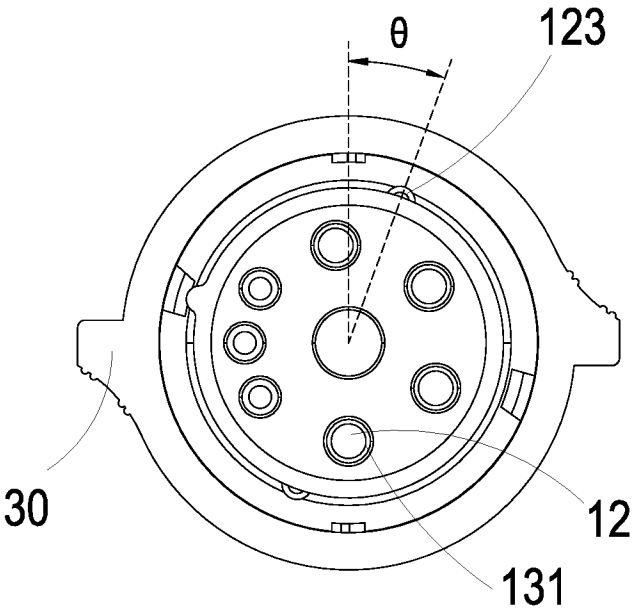
FIG. 21 is a front view of FIG. 19.
Figure 24:
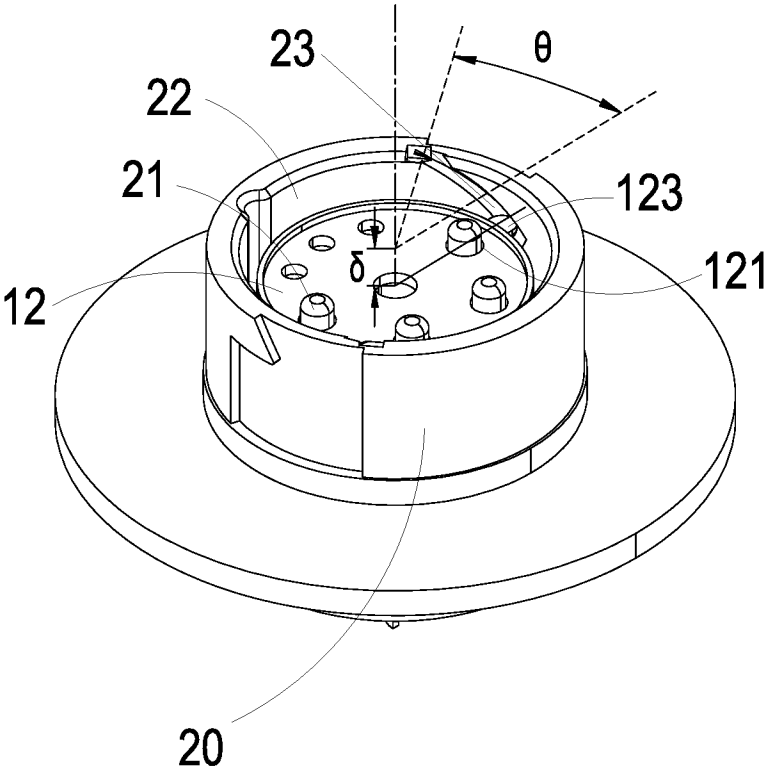
FIG. 24 is a schematic perspective view showing the relationship between the second adapter and the rotating cover while the rotating cover is located at the second position according to the second embodiment of the present disclosure.
Figure 23:
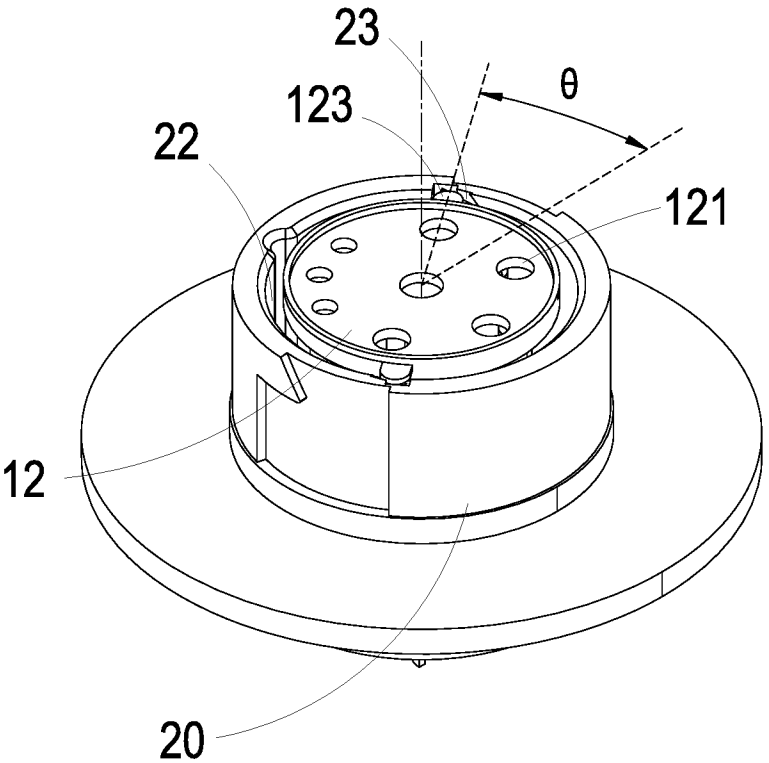
FIG. 23 is a schematic perspective view showing the relationship between the second adapter and the rotating cover while the rotating cover is located at the first position according to the second embodiment of the present disclosure.

Please further refer to FIGS. 19 to 24. FIG. 19 is a schematic perspective view showing the first adapter including the rotating cover located at a first position according to the second embodiment of the present disclosure. FIG. 20 is a schematic perspective view showing the first adapter including the rotating cover located at a second position according to the second embodiment of the present disclosure. FIG. 21 is a front view of FIG. 19. FIG. 22 is a front view of FIG. 20. FIG. 23 is a schematic perspective view showing the relationship between the second adapter and the rotating cover while the rotating cover is located at the first position according to the second embodiment of the present disclosure. FIG. 24 is a schematic perspective view showing the relationship between the second adapter and the rotating cover while the rotating cover is located at the second position according to the second embodiment of the present disclosure. In the embodiment, the rotating cover 12 is rotated at the specific angle θ between a first position (referring to FIGS. 19 and 21) and a second position (referring to FIGS. 20 and 22). When the second adapter 20 tends to insert into the first adapter 10 for allowing the at least one second electrical contact element 21 of the second adapter 20 to contact with the at least one first electrical contact element 111 of the first adapter 10, the at least one second electrical contact element 21 has to pass through the at least one second through hole 131 of the front cover 13, the at least one first through hole 121 of the rotating cover 12 and then engages with the at least one first electrical contact element 111 of the main body 11, so as to achieve the electrical connection.

With the action of inserting the second adapter 20 into the first adapter 10 for allowing the at least one second electrical contact element 21 of the second adapter 20 to contact with the at least one first electrical contact element 111 of the first adapter 10, the guiding groove 23 disposed on the inner wall of the second adapter 20 abuts against the protruding pin 123 of the rotating cover 12 to drive the rotating cover 12 to rotate relative to the main body 11 and the front cover 13. Namely, the protruding pin 123 of the rotating cover 12 is moved along the guiding groove 23 of the second adapter 20. Consequently, the rotating cover 12 is driven to rotate and move from the first position (referring to FIGS. 19 and 21) to the second position (referring to FIGS. 20 and 22). The at least one first through hole 121 of the rotating cover 12 is rotated to align with the at least one second through hole 131 of the front cover 13 and the at least one first electrical contact element 111, and the at least one second electrical contact element 21 can contact with the at least one first electrical contact element 111 directly.

Alternatively, with the action of detaching the second adapter 20 from the first adapter 10 for allowing the at least one second electrical contact element 21 of the second adapter 20 to separate from the at least one first electrical contact element 11 of the first adapter 10, the guiding groove 23 disposed on the inner wall of the second adapter 20 abuts against the protruding pin 123 of the rotating cover 12 to drive the rotating cover 12 to rotate and move from the second position (referring to FIGS. 20 and 22) to the first position (referring to FIGS. 19 and 21). Under this circumstance, the protruding pin 123 of the rotating cover 12 is moved along the guiding groove 23 of the second adapter 20. At the same time, the at least one first through hole 121 of the rotating cover 12 is rotated to misalign with the at least one second through hole 131 of the front cover 13 and the at least one first electrical contact element 111, so as to insulate the communication between the at least one first electrical contact element 111 and the at least one second through hole 131 of the front cover 13. Namely, after the second adapter 20 and the first adapter 10 are separated from each other, the rotating cover 12 is rotated to seal the at least one first electrical contact element 111 of the first adapter 10.

On the other hand, in response to the motion of connecting the second adapter 20 with the first adapter 10, the rotating cover 12 is rotated at the specific angle θ, moved from the first position (referring to FIG. 23) to the second position (referring to FIG. 24) and moved at a specific depth δ relative to the second adapter 20. It allows the at least one second electrical contact element 21 to pass through the at least one first through hole 121 of the rotating cover 12, so as to further connect with the at least one first electrical contact element 111 of the first adapter 10. Alternatively, in response to the motion of detaching the second adapter 20 from the first adapter 10, the rotating cover 12 is rotated at the specific angle θ from the second position (referring to FIG. 24) to the first position (referring to FIG. 23) and separated from the second adapter 20. Namely, the motion of the rotating cover 12 is controlled by the actions of the second adapter 20 having the guiding groove 23 abutting against the protruding pin 123 of the rotating cover 12. The motion path of the rotating cover 12 relative to the second adapter 20 is adjustable by changing the design of the guiding groove 23. In an embodiment, the first adapter 10 includes for example a spring (not shown) connected with the rotating cover 12 to maintain the rotating cover 12 at the first position. When the second adapter 20 is moved and the guiding groove 23 abuts against the protruding pin 123 of the rotating cover 12, it is easy to drive the rotating cover 12 against the maintain force of the spring. When the second adapter 20 is separated from the first adapter 10, the maintain force of the spring can make sure that the rotating cover 12 is maintained at the first position. Accordingly, the rotating cover 12 is operated by an automatic action mechanism.

The adapter assembly 1*a* is applicable to various fields for conveying electric power from a power supplying end to a power receiving end. In an embodiment, the adapter assembly 1*a* including a first adapter 10 and a second adapter 20 can be used for transferring electric power from a charging station or a utility power source to a battery mounted in an electric vehicle or a hybrid electric vehicle. In some embodiments, the adapter assembly 1*a* including an industrial plug and a socket can be used for transferring power from a power source to an electrical equipment. It is noted that the adapter assembly is not limited to the above embodiments and can be varied according to the practical requirements.

In accordance with the concept of the present disclosure, the first electrical contact element 111 of the first adapter 10 is covered by the rotating cover 12 when the first adapter 10 is not in use or when the second adapter 20 is detached from the first adapter 10. The first electrical contact element 111 of the first adapter 10 is uncovered by the rotating cover 12 at the moment when the second adapter 20 is fitted with the first adapter 10. Consequently, the first adapter 10 and the second adapter 20 can prevent electrical shock issue and provide waterproof and dustproof functions without using additional cover. Preferably but not exclusively, the structure of the first adapter 10 and the adapter assembly 1*a* are waterproof and dustproof and in complying with the IP 24 class of protection of the IEC/EN 60529 standard of the international Electrotechnical Commission.

From the above descriptions, the present disclosure provides an adapter assembly with safety design to avoid electrical shock issue. The adapter assembly includes a rotating cover driven by the action of inserting the second adapter into the first adapter or pulling out the second adapter from the first adapter. When the second adapter is inserted into the first adapter, the rotating cover is driven to open and uncover the first electrical contact elements, so that the second adapter can match and fit with the first adapter correctly to achieve the purposes of the electrical connection and the sealing protection at the same time. When the second adapter is pulled out from the first adapter, the rotating cover is driven to close and cover the first electrical contact elements, so that the first adapter can be insulated completely to achieve the purposes of the insulation and the sealing protecting at the same time. The adapter assembly of the present disclosure can avoid electrical shock issue and provide waterproof and dustproof functions. Since the rotating cover is operated by an automatic action mechanism, it is labor-saving, time-saving and cost-saving to maintain the safety of utilizing the adapter assembly.

While the disclosure has been described in terms of what is presently considered to be the most practical and preferred embodiments, it is to be understood that the disclosure needs not be limited to the disclosed embodiment.

What is claimed is:

1. An adapter assembly, comprising:

a first adapter comprising a main body and a rotating cover, wherein the main body comprises at least one first electrical contact element, and the rotating cover is pivotally connected with the main body and rotated between a first position and a second position relative to the main body, wherein the rotating cover comprises at least one first through hole and at least one protruding pin, wherein when the rotating cover is rotated to the first position, the at least one first through hole and the at least one first electrical contact element are misaligned with each other, wherein when the rotating cover is rotated to the second position, the at least one first through hole and the least one first electrical contact element are aligned with each other; and a second adapter matched with the first adapter and comprising at least one second electrical contact element, an accommodation space and at least one guiding groove, wherein the at least one second electrical contact element is disposed within the accommodation space, and the at least one guiding groove is disposed on an inner wall of the accommodation space, wherein when the first adapter and the second adapter are matched with each other, the at least one guiding groove abuts against the at least one protruding pin of the rotating cover to drive the rotating cover to rotate from the first position to the second position, the at least one second electrical contact element is aligned to the at least one first through hole and the at least one first electrical contact element, and the at least one second electrical contact element and the at least one first electrical contact element are electrically connected with each other.

2. The adapter assembly according to claim 1, wherein the at least one protruding pin of the rotating cover is disposed on an outer edge of the rotating cover and protruded outwardly from the outer edge of the rotating cover.

3. The adapter assembly according to claim 1, wherein when the rotating cover is rotated to the first position, the rotating cover covers the at least one first electrical contact element, wherein when the rotating cover is rotated to the second position, the rotating cover uncovers the at least one first electrical contact element.

4. The adapter assembly according to claim 1, wherein the first adapter and the second adapter are a female adapter and a male adapter, respectively.

5. The adapter assembly according to claim 1, wherein the rotating cover comprises a central opening, and the main body comprises a first fastening hole and a fastening element, wherein the fastening element is located through the central opening and engaged with the first fastening hole, and the rotating cover is pivotally connected with the main body through the fastening element.

6. The adapter assembly according to claim 5, wherein the first adapter further comprises a front cover having a second fastening hole spatially corresponding to the first fastening hole and the fastening element, wherein the main body, the rotating cover and the front cover are stacked sequentially with each other, and the fastening element is located through the first fastening hole, the central opening and the second fastening hole, so as to fix the front cover on the main body.

7. The adapter assembly according to claim 6, wherein the front cover comprises at least one second through hole spatially corresponding to the at least one first electrical contact element of the main body.

8. The adapter assembly according to claim 6, wherein the front cover further comprises a recess disposed adjacent to an outer edge of the front cover, wherein the at least protruding pin runs through the recess and is protruded from an outer edge of the main body.

9. The adapter assembly according to claim 6, wherein the first adapter comprises a first positioning element disposed on an outer wall of the front cover, and the second adapter comprises a second positioning element disposed on the inner wall of the accommodation space and spatially corresponding to the first positioning element, wherein when the first adapter and the second adapter are matched with each other, the first positioning element and the second positioning element are aligned and engaged with each other, wherein the first positioning element and the second positioning element are a protrusion and a recess, respectively.

10. The adapter assembly according to claim 6, wherein the front cover includes a specific thickness so as to provide a safety distance.

11. The adapter assembly according to claim 1, further comprising an outer ring disposed around the first adapter and having a receiving opening, wherein when the first adapter and the second adapter are matched with each other, the second adapter is partially received within the receiving opening.

12. The adapter assembly according to claim 11, wherein when the outer ring is fit around the first adapter, the main body and the at least one protruding pin are received within the receiving opening, and the at least one protruding pin is protruded from an outer edge of the main body.

13. The adapter assembly according to claim 11, wherein the outer ring is fit around the first adapter and rotatable relative to the first adapter around the first adapter in a specific range, wherein the main body comprises an elastic member disposed on an outer wall of the main body, and the outer ring comprises an engaging pin disposed on an inner wall of the outer ring and spatially corresponding to the elastic member, wherein the elastic member abuts against the engaging pin to make the outer ring limited in a fixed position relative to the first adapter.

14. The adapter assembly according to claim 13, wherein the outer ring further comprises a latching pin disposed on the inner wall of the outer ring, and the second adapter comprises a latching element disposed on an outer wall of the second adapter and spatially corresponding to the latching pin, wherein when the first adapter and the second adapter are matched with each other, the latching pin and the latching element are engaged with each other, wherein the latching element further comprises a recess portion, wherein when the outer ring is limited in the fixed position, the latching pin is slide into the recess portion, so as to latch the second adapter on the first adapter through the outer ring.

15. The adapter assembly according to claim 1, wherein the at least one guiding groove is inclined from an opening end of the accommodation space and disposed on the inner wall of the accommodation space.

16. The adapter assembly according to claim 1, wherein the at least one protruding pin includes at least two protruding pins opposite to each other and symmetrically disposed around the edge of the rotating cover, wherein the at least one guiding groove includes at least two guiding grooves opposite to each other and disposed on the inner wall of the accommodation space.

17. The adapter assembly according to claim 1, further comprising a wire assembly combined with the first adapter.

18. The adapter assembly according to claim 1, wherein the rotating cover is made of a polytetrafluoroethylene material.

19. The adapter assembly according to claim 1, wherein the at least one first electrical contact element and the at least one the second electrical contact element are a female conductive terminal and a male conductive terminal, respectively.

20. The adapter assembly according to claim 1, wherein when the second adapter is matched to the first adapter, the at least one protruding pin of the rotating cover is guided by the at least one guiding groove to rotate at a specific angle and move at a specific depth relative to the second adapter.

* * * * *